US006536987B2

(12) United States Patent
Chang

(10) Patent No.: US 6,536,987 B2
(45) Date of Patent: Mar. 25, 2003

(54) QUICK MANHOLE/HANDHOLE CONSTRUCTION METHOD AND RELATED DEVICES

(76) Inventor: Ming-Huang Chang, No. 25, Tzu Chiang Rd., Chi Tu Dist., Keelung City (TW)

( * ) Notice: Subject to any disclaimer, the term of this patent is extended or adjusted under 35 U.S.C. 154(b) by 0 days.

(21) Appl. No.: 09/866,611

(22) Filed: May 30, 2001

(65) Prior Publication Data

US 2003/0002921 A1 Jan. 2, 2003

(51) Int. Cl.[7] ..... E01C 23/00; E21C 25/00; E21B 7/00

(52) U.S. Cl. ..... 404/25; 404/72; 299/39.1; 299/41.1; 175/57

(58) Field of Search ..... 404/25, 72; 175/57; 52/19, 20; 220/3.2; 299/39.1, 39.2, 41.1

(56) References Cited

U.S. PATENT DOCUMENTS 3,649,071 A * 3/1972 Graff ..... 299/15
4,924,951 A * 5/1990 Paulson ..... 175/315
5,470,131 A * 11/1995 Nolan et al. ..... 299/41.1
5,522,646 A * 6/1996 Friedman et al. ..... 299/39.3
5,934,820 A * 8/1999 Hinkle ..... 249/188

FOREIGN PATENT DOCUMENTS

JP 8-326082 * 12/1996
JP 11-323821 * 11/1999

* cited by examiner

*Primary Examiner*—Gary S. Hartmann
(74) *Attorney, Agent, or Firm*—Rosenberg, Klein & Lee

(57) ABSTRACT

A quick manhole/handhole construction method and related devices is provided that includes a cutting unit and a manhole/handhole cover lifter. The cutting unit includes a radial feeding device, a cutting plate, a base, and a vessel, for easily carrying out the cutting task by fixing the base and operating the radial feeding device. The lifter is a single frame, and can be used to lift a manhole/handhole cover.

7 Claims, 10 Drawing Sheets

QUICK MANHOLE/HANDHOLE CONSTRUCTION METHOD AND RELATED DEVICES

BACKGROUND OF THE INVENTION

The present invention relates to a quick manhole/handhole construction method and related devices having some simple and convenient units, such as a cutting unit with quick positioning ability and a manhole/handhole lifter, etc. The units are applied due to the characteristics of these devices and corresponding construction steps of the present invention to advance the technology of quick replacement of a manhole/handhole.

DESCRIPTION OF THE PRIOR ART

A commonly known manhole/handhole is the outlet of a culvert or sewer for burying electrical cables and water pipes. In order to connect the manhole/handhole set with the culvert correctly, the manhole/handhole has to be set by a locking method. When the road surface is varied due to repair of the road, or damage to the manhole/handhole, the manhole/handhole needs to be replaced. The common task encountered is how can the manhole/handhole be moved easily and effortlessly, and then how can the manhole/handhole set that is fastened on the culvert be removed. The latter is actually the most difficult thing. In a commonly seen construction method for replacing a manhole/handhole, the manhole/handhole seat is first taken out by destructive methods of sapping the road surface and digging the culvert. After the new manhole/handhole is positioned, the culvert and the road surface are filled. The construction method described above wastes not only time but also effort, and the structure of the original culvert and the road surface are destroyed such that their life is reduced. A manhole cover moving device, as seen in Taiwan Patent 380654, is made up of a support set, a jack mechanism, a steering mechanism and a turning grip. When the structure described above is used, the jack is fastened first, and other mechanisms are extended one by one for operation. Therefore, the device is inconvenient to use, and needs to be folded up after use, otherwise it occupies too much space. In addition, the devices disclosed by Taiwan Patent 243877 and Taiwan Patent 262900, "Tools for lifting and moving a manhole cover with rolling tubes, prying tubes, hooks, and a crowbar", need many tools such that many resources are used for bringing these tools. Besides, these tools have to work in coordination with each other, and if the user loses one of these tools, the practicality of these tools is decreased substantially.

In addition, what has to be mentioned is that for replacement of a manhole/handhole, even with advanced countries, such as Japan, with huge capital for researching and manufacturing, common methods of replacement of a manhole/handhole still use manpower or machines to proceed with digging and replacement. In addition to the time and effort that is wasted on the task, where the task is undertaken in an advanced country with vast area, the speed of replacement can't keep up with the speed of damage. How the replacement of the manhole/handhole is carried out with more efficiency and less human and commodity resources is the thing that is done well only in advanced countries. For example, the manhole/handhole replacement related equipments from Japan costs over ten million NT, and needs much manpower to operate and transport. Thus, it can be shown that the conventional construction method of a manhole/handhole has many disadvantages and needs to be improved.

SUMMARY OF THE INVENTION

The purpose of the present invention is to provide a quick manhole/handhole construction device, which uses feeding screws of the cutting unit and the theory of a planet gear mechanism to make the cutting unit position quickly and carry out the horizontal cutting task.

The second purpose of the present invention is to provide a quick manhole/handhole construction device, which uses the extended screw feeding mechanism to make the cutting unit add the function of cutting an asphalt road surface around the manhole/handhole.

Another purpose of the present invention is to provide a quick manhole/handhole construction device, which uses a position hook of the present invention to make the cutting unit reach the position quickly when the cutting unit is placed into a manhole/handhole or a culvert.

Another further purpose of the present invention is to provide a quick manhole/handhole construction device, which has a single frame combined with a pair of fastened wheels and a pair of mobile wheels, and uses the principle of a lever to move the manhole/handhole cover quickly and effortlessly.

The other purpose of the present invention is to provide a quick manhole/handhole construction method, which can carry out replacing the manhole/handhole cover smoothly via every unit of the present invention, even if under the condition that the resources are limited.

The related device corresponding to a quick manhole/handhole construction method that can achieve the purposes described above, at least comprises a cutting unit and a lifter. The cutting unit further comprises a radial feeding device having a pneumatic motor (or a hydraulic motor) combined with a screw feeding mechanism. The screw feeding mechanism and the fixing holder of the chassis are connected to separately add an extended screw feeding mechanism, and a fastening holder is fixed at the final end of the screw feeding mechanism and is normal to the fixing holder of the chassis. The radial feeding device can be fastened on the fastening holder of the extended screw feeding mechanism. The cutting unit includes a cutting plate, which is a circular blade unit covered by a shelter. The shelter has a placing prop fastened at a proper position on the exterior thereof. A chassis is provided whereon a fixing holder is set and a column casing is appended at a proper position on a periphery thereof, and a steering gear mechanism is set at the top of the column casing. A shaft is extended downward from the steering gear mechanism, and a planet gear is fastened on the shaft. The cutting unit includes a base. A fixed gear is fastened on the upper surface of the base and at least three extending arms, which can be controlled via adjusting screws, are set on the bottom face, dividing the area of the bottom face in equal parts. A vessel connecting with an output duct is provided, and is able to be placed into the placing prop set on the shelter. The shelter and the radial feeding device are fastened to the fixing holder of the chassis, and the blade of the cutting plate is fastened to the pneumatic motor of the radial feeding device, and the chassis is set at the top of the base, and the planet gear set on the chassis is able to engage the fixed gear set on the base.

The lifter further comprises a frame. The frame has some symmetrical position holes. A pair of fastened wheels containing two wheels are provided, which are respectively set at two sides of one end of the frame. A pair of mobile wheels containing two wheels are provided at two sides of the frame and respectively coupled with a mobile link. The lifter includes a hook module. The main part of the hook module includes a stick with two sleeves which have positioning holes and can slide on the frame, respectively set at two ends. A pair of other mobile sleeves are provided, respectively having hooks at the bottom and several positioning holes at the top. The lifter further includes a plurality of the positioning pins for fastening the hook module. A pair of folding units are provided which comprises two foldable links and a string. A stopping unit comprising at least a stopping plate is provided which is fixed at a suitable position on the frame and prevent the frame from contacting the ground when the frame is horizontally positioned. The pair of fastened wheels are respectively set at both sides of one end of said frame, and corresponds to the pair of mobile wheels, and the pair of folding units are used to link the fastened wheels and the mobile wheels, and the pair of folding units are connected by a string passing through the frame such that when the string is pulled, the pair of fastened wheels and the pair of mobile wheels can be pulled by the pair of folding units and the foldable links between the wheels can be folded. A pair of positioning pins can pass through the positioning holes of the hook module and the frame at the same time such that quick positioning of the mobile hooks can be accomplished.

A construction method corresponding to the devices for quick construction of a manhole/handhole comprises at least the steps as follows:

Step 1, using a lifter to lift and move a manhole/handhole cover;

Step 2, placing and positioning the cutting unit into the manhole/handhole, and using the cutting unit to cut the surface of the asphalt road around the manhole/handhole;

Step 3, placing and positioning the cutting unit into the culvert and using the cutting unit to cut the culvert connected to the bottom of the manhole/handhole;

Step 4, hoisting up the manhole/handhole;

Step 5, placing a new manhole/handhole;

Step 6, using the lifter to move and set the manhole/handhole cover;

Step 7, laying the surface of the asphalt road around the manhole/handhole.

BRIEF DESCRIPTION OF THE DRAWINGS

The drawings disclose an illustrative embodiment of the present invention which serves to exemplify the various advantages and objects thereof, and are as follows.

LIST OF REFERENCE NUMBERS

| | | | |
|---|---|---|---|
| H1 | Culvert | H2 | Manhole/handhole |
| H3 | Manhole/handhole cover | m | Positioning pin |
| m2 | Positioning pin | n1 | Positioning hole |
| n2 | Positioning hole | S1 | Screw |
| S2 | Screw | S3 | Screw |
| S4 | Screw | AC | Surface of an asphalt road |
| S5 | Screw | S6 | Nut |
| S7 | Screw | S | Link |
| w | Vessel | w1 | Duct |
| 1 | Cutting unit | 1a | Radial feeding device |
| 1a1 | Pneumatic motor | 1a11 | Shaft |
| 1a2 | Housing | 1a3 | Turning wheel |
| 1a31 | Bevel gear | 1a4 | Guide block |
| 1a41 | Hole | 1a42 | Sliding trough |
| 1a5 | Sliding block | 1a51 | Slideway |
| 1a52 | Block | 1a53 | Screw |
| 1a54 | Bevel gear | 1a6 | Screw feeding mechanism |
| 1b | Cuffing plate | 1b1 | Shelter |
| 1b2 | Blade | 1b3 | Lock plate |
| 1b11 | Placing prop | 1b12 | Fixing plate |
| 1b31 | Hole | 1b4 | Blade unit |
| 1c | Chassis | 1c1 | Steering gear mechanism |
| 1c11 | Bevel gear pair | 1c12 | Turning grip |
| 1c2 | Shaft | 1c3 | Planet gear |
| 1c4 | Fixing holder | 1c5 | Gap |
| 1c6 | Shield cover | 1c7 | Guide shaft |
| 1c8 | Column casing | 1d | Base |
| 1d1 | Extending arm | 1d11 | Fastening set |
| 1d12 | Fastening nut | 1d13 | Screw bolt |
| 1d14 | Internal sleeve | 1d15 | External sleeve |
| 1d16 | Screw hole | 1d2 | Extending arm |
| 1d3 | Extending arm | 1d4 | Base plate |
| 1d41 | Fixed gear | 1d42 | Support set |
| 1d43 | Guiding hole | 2 | Lifter |
| 21 | Frame | 2a | Hook module |
| 23 | Stopping unit | 231 | Stopping plate |
| 24 | String | 26 | Stick |
| 261 | Mobile sleeve | 262 | Mobile sleeve |
| 263 | Hook | 264 | Hook |
| 265 | Sleeve | 266 | Sleeve |
| 291 | Position hole | 301 | Position hole |
| 31 | Folding unit | 32 | Folding unit |
| 311 | Foldable link | 312 | Foldable link |
| 321 | Foldable link | 322 | Foldable link |
| 4a | A pair of fixed wheels | 4b | A pair of mobile wheels |
| 41 | Wheel | 42 | Wheel |
| 43 | Wheel | 44 | Wheel |
| 51 | Mobile link | 52 | Mobile link |
| 6 | Extended screw feeding mechanism | 61 | Steering bevel gear pair |
| 62 | Turning wheel | 63 | Sliding block |
| 631 | Screw | 632 | Block |
| 64 | Slideway | 65 | Guide block |
| 66 | Sliding trough | 67 | Sliding slot |
| 671 | Screw hole | 68 | Fastening prop |
| 69 | Fastening holder | 691 | Dust cover |
| 7a | Position hook | 7b | Position hook |
| 7c | Position hook | 7d | Position hook |
| 7 | Position hook | 71 | Hook |
| 73 | Stick | 81 | Step 1 |
| 82 | Step 2 | 83 | Step 3 |
| 84 | Step 4 | 85 | Step 5 |
| 86 | Step 6 | 87 | Step 7 |

DETAILED DESCRIPTION OF THE PREFERRED EMBODIMENT

Figure 1:
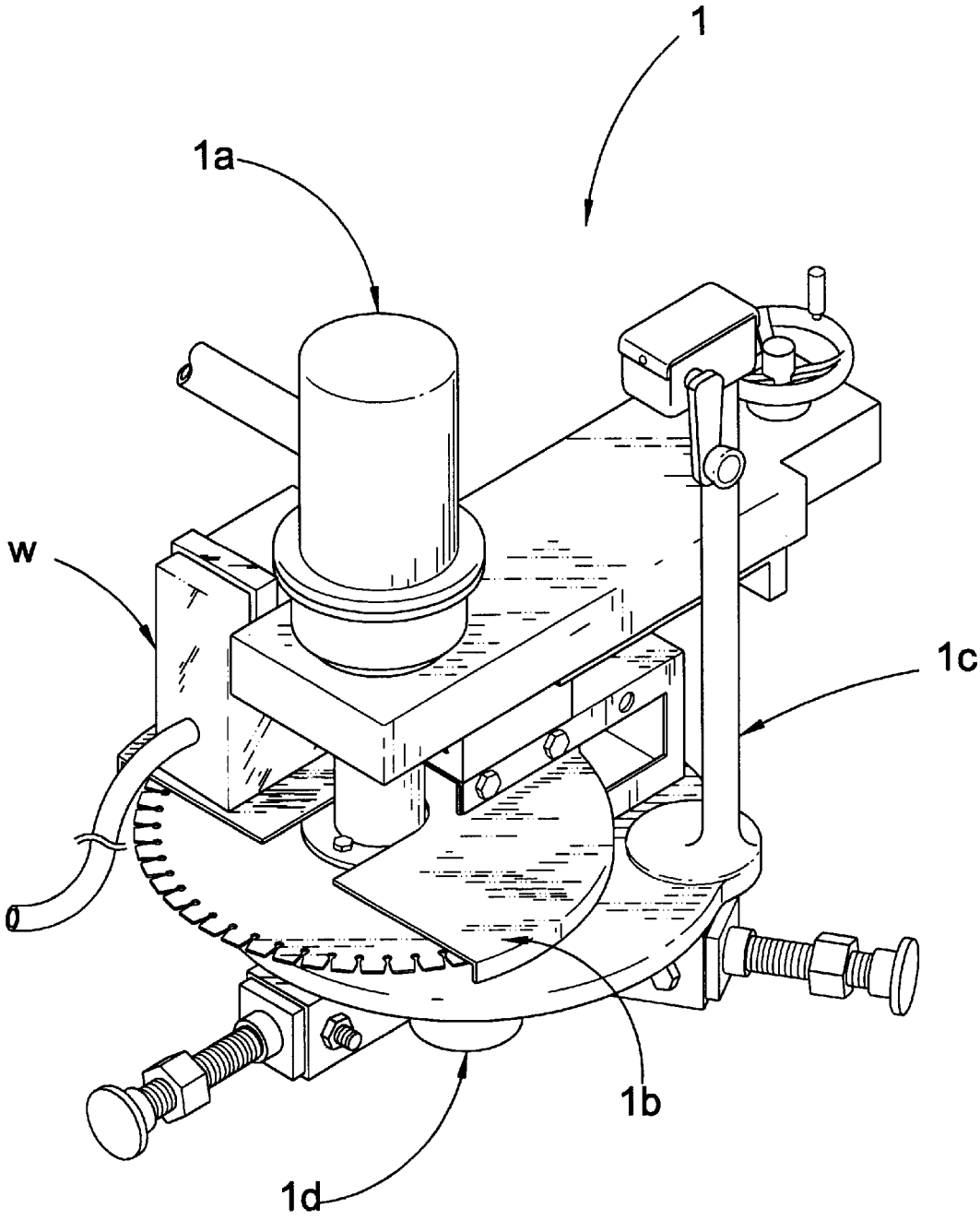
FIG. 1 is a perspective view of the cutting unit of a quick manhole/handhole construction method and related devices of the present invention.
Figure 2:
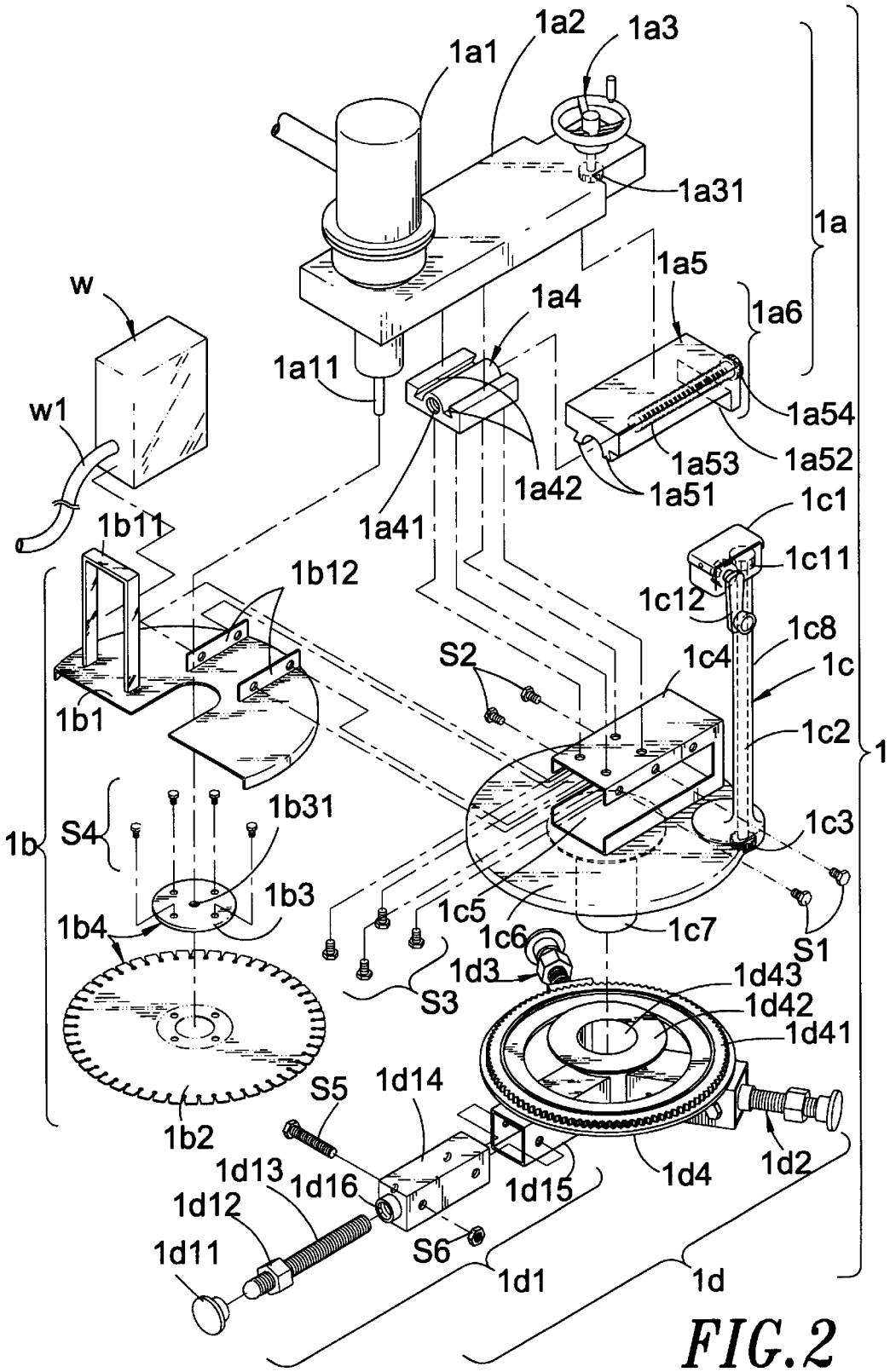
FIG. 2 is an exploded view of the cutting unit of the present invention.

Referring to FIG. 1 and FIG. 2, the cutting unit 1 is mainly composed of a radial feeding device 1*a*, a cutting plate 1*b*, a chassis 1*c*, a base 1*d* and a vessel w. The radial feeding device 1*a* is mainly composed of a pneumatic motor 1*a*1 and a screw feeding mechanism 1*a*6. The pneumatic motor 1*a*1 is mounted on a housing 1*a*2, and a turning wheel 1*a*3 is mounted at one end of the housing 1*a*2, and then the shaft of the turning wheel is extended such that a bevel gear 1*a*31 is coupled thereto. A hole 1*a*41 is formed at the proper position of the guide block, and has threads. Both sides of the top of the guide block 1*a*4 respectively have a sliding trench, and the top of the guide block 1*a*4 is fastened to the bottom of the housing 1*a*2. Both sides of the bottom of the sliding block 1*a*5 respectively have a slideway 1*a*51, and one end of the sliding block 1*a*5 has a stopping block 1*a*52 joining a screw 1*a*53. The screw 1*a*53 can rotate at the joint 6 between the screw 1*a*53 and the stopping block 1*a*52. A bevel gear 1*a*54 for engaging the bevel gear 1*a*31 of the extended shaft of the turning wheel 1*a*3 is mounted at one end of the screw 1*a*53. The cutting plate 1*b* is a circular blade unit 1*b*4 and is covered with a shelter 1*b*1, and the blade unit 1*b*4 is made of a blade 1*b*2 with the lock plate 1*b*3 fixed on the blade 1*b*2 via screws S4, and a hole 1*b*31 operating in coordination with the shaft 1*a*11 of the pneumatic motor 1*a*1 is set at the center of the lock plate 1*b*3, and a placing prop 1*b*11 and a pair of fixing plates 1*b*12 are set at proper positions on the exterior of the shelter 1*b*1.

The chassis 1*c* mainly comprises a chassis shield cover 1*c*6, and a fixing holder 1*c*4 is mounted on the chassis shield cover 1*c*6. The fixing holder 1*c*4 has a gap 1*c*5. An extended column casing 1*c*8 is mounted at a proper position on the chassis shield cover 1*c*6, and a steering gear mechanism 1*c*1 is mounted at the top of the column casing 1*c*8. The steering gear mechanism 1*c*1 has a shaft 1*c*2 extending downwardly with a planet gear 1*c*3 fastened thereto. A guide shaft 1*c*7 is mounted below the chassis shield cover 1*c*6. A base plate 1*d*4 having a fixed gear 1*d*41 is mounted on the base 1*d*. The fixed gear 1*d*41 engages the planet gear 1*c*3 of the chassis 1*c*. Three extending arms 1*d*1, 1*d*2, 1*d*3 with the same structure are mounted at the bottom of the base plate, dividing the area of the bottom surface thereof into equal parts. The extending arms 1*d*1, 1*d*2, 1*d*3 can be adjusted and controlled by screws.

The extended arm 1*d*1 comprises a fastening set 1*d*11 which is slipped on the screw bolt 1*d*13, and a fastening nut 1*d*12 is located at the proper position on the screw bolt 1*d*13. The end without the connecting fastening set 1*d*11 of the screw bolt 1*d*13 is disposed within the screw hole 1*d*16 of the internal sleeve 1*d*14. The internal sleeve 1*d*14 is used together with the external sleeve 1*d*15, and the position can be fixed by coordination of a screw S5 and a nut S6. The structure of the extending arm 1*d*2 and 1*d*3 are the same as the extending arm 1*d*1. A support set 1*d*42 is located above the base 1*d*, and a guiding hole 1*d*43 is formed at the center of the support set 1*d*42. A duct w1 is connected to a proper position of the exterior of the vessel w. The fixing plates 1*b*12 of the cutting plate 1*b*, the screws S1 and S2 are fixed on the fixing holder 1*c*4 of the chassis. The lock plate 1*b*3 of the cutting plate 1*b* is fixed at the bottom of the pneumatic motor 1*a*1, and the hole 1*b*31 of the lock plate 1*b*3 works in cooperation with the shaft 1*a*11 of the pneumatic motor 1*a*1 . The vessel w is located at the placing prop 1*b*11 of the cutting plate 1*b*. The guide shaft 1*c*7 of the chassis 1*c* is inset into the guiding hole 1*d*43 of the chassis 1*d*, and the planet gear 1*c*3 engages the fixed gear of the base 1*d*.

Figure 3A:
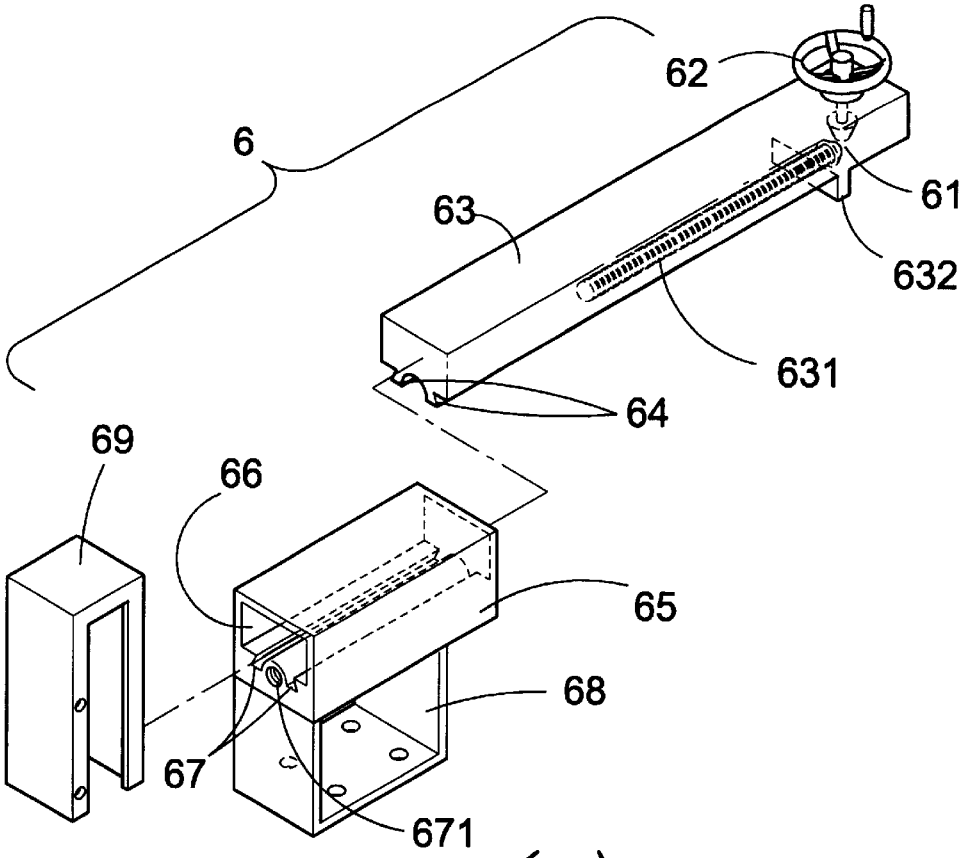
FIG. 3(A) is an exploded view of the extended screw feeding mechanism of the present invention.
Figure 3B:
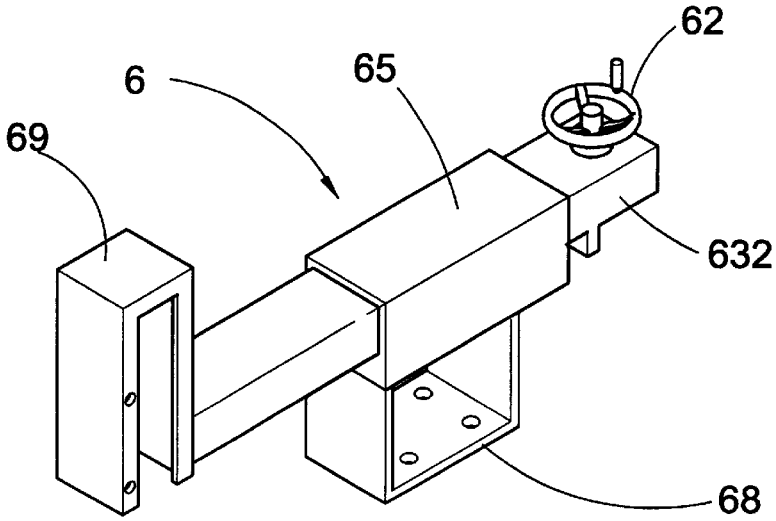
FIG. 3(B) is a perspective view of the extended screw feeding mechanism of the present invention.
Figure 3C:
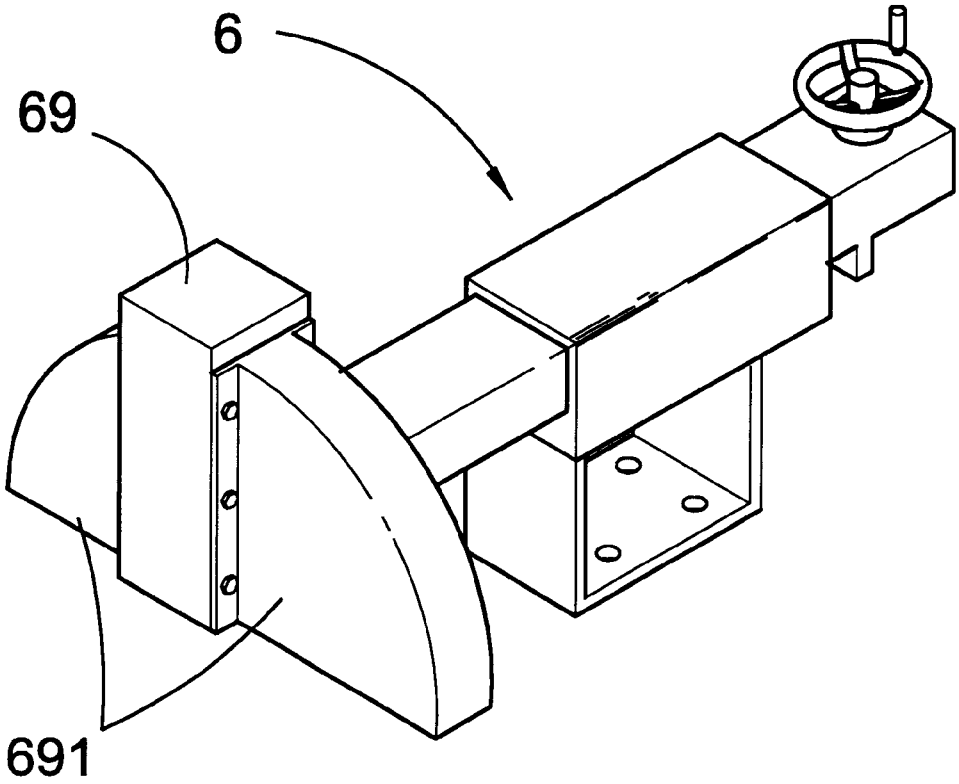
FIG. 3(C) is a perspective view of the fastening holder appended with the dust cover of the present invention.

Referring now to FIG. 3(A) and FIG. 3(B), the main structure of the extended screw feeding mechanism 6 comprises a guide block 65, a sliding block 63, a fastening prop 68 and a fixing holder 69. A turning wheel 62 is mounted at one end of the sliding block 63, and a steering bevel gear pair 61 is respectively mounted to the extended shaft of the turning wheel 62 and a screw 631 which is joined on the block 632 of the sliding block 63. A set of slideways 64 are set at the bottom of the sliding block 63, and a fixing holder 69 is located at the other end of the sliding block 63. The fixing holder 69 can have a dust cover 691 added thereto, as shown in FIG. 3(C). The fastening prop 68 is fixed at the bottom of the guide block 65, and a sliding trough 66 is formed in the interior of the guide block 65. A pair of sliding slots 67 are formed in the bottom of the sliding trough 66. A screw hole 671 is formed parallel to the sliding trough 66 at a proper position of the guide block 65. The slideways 64 of the sliding block 63 can slide in the sliding slots 67 of the guide block 65. The screw 631 of the sliding block 63 operates in coordination with the screw hole 671 of the guide block 65.

Figure 4A:
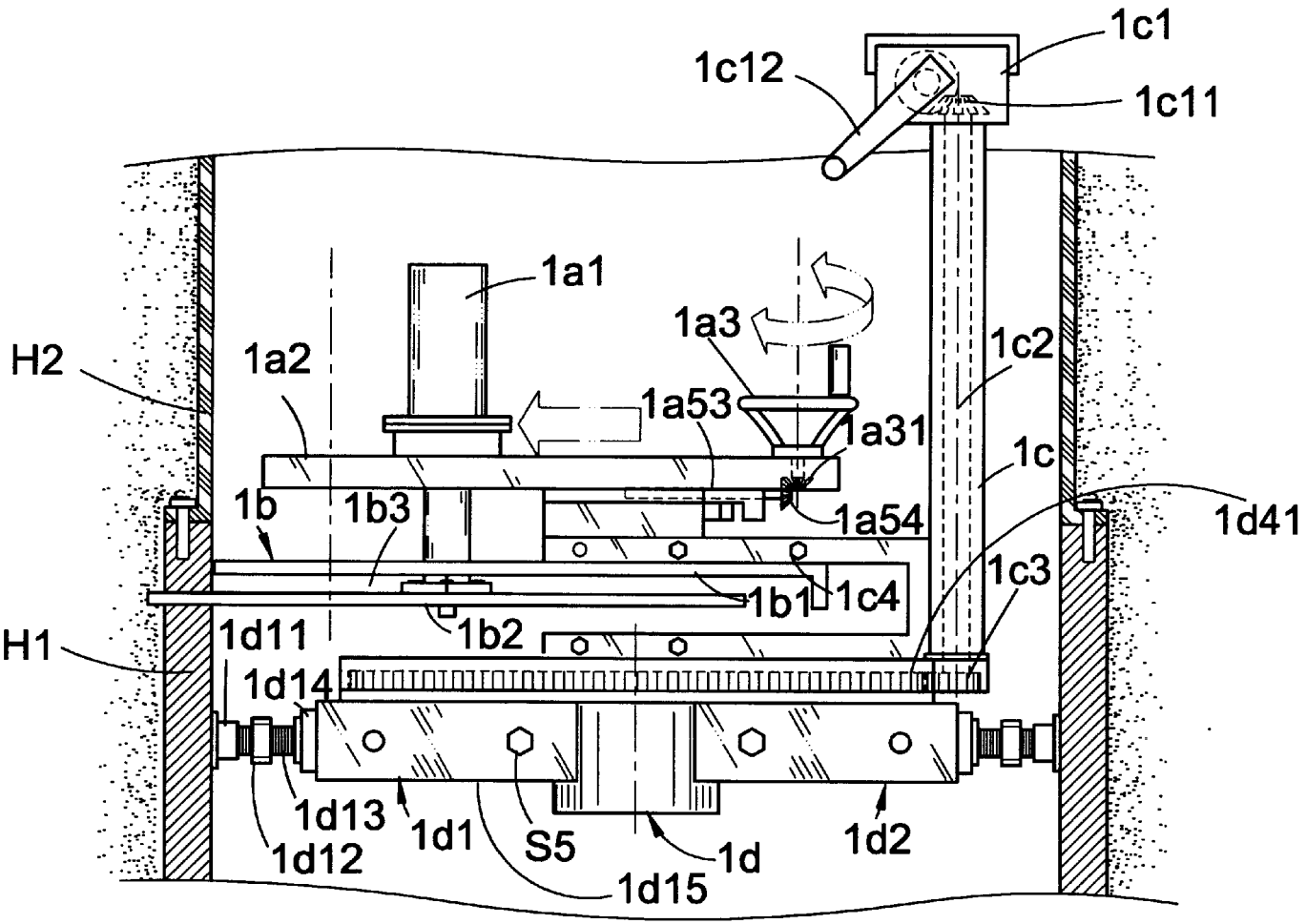
FIG. 4(A) is an elevation view of the cutting unit of the present invention horizontally cutting the culvert.
Figure 4:
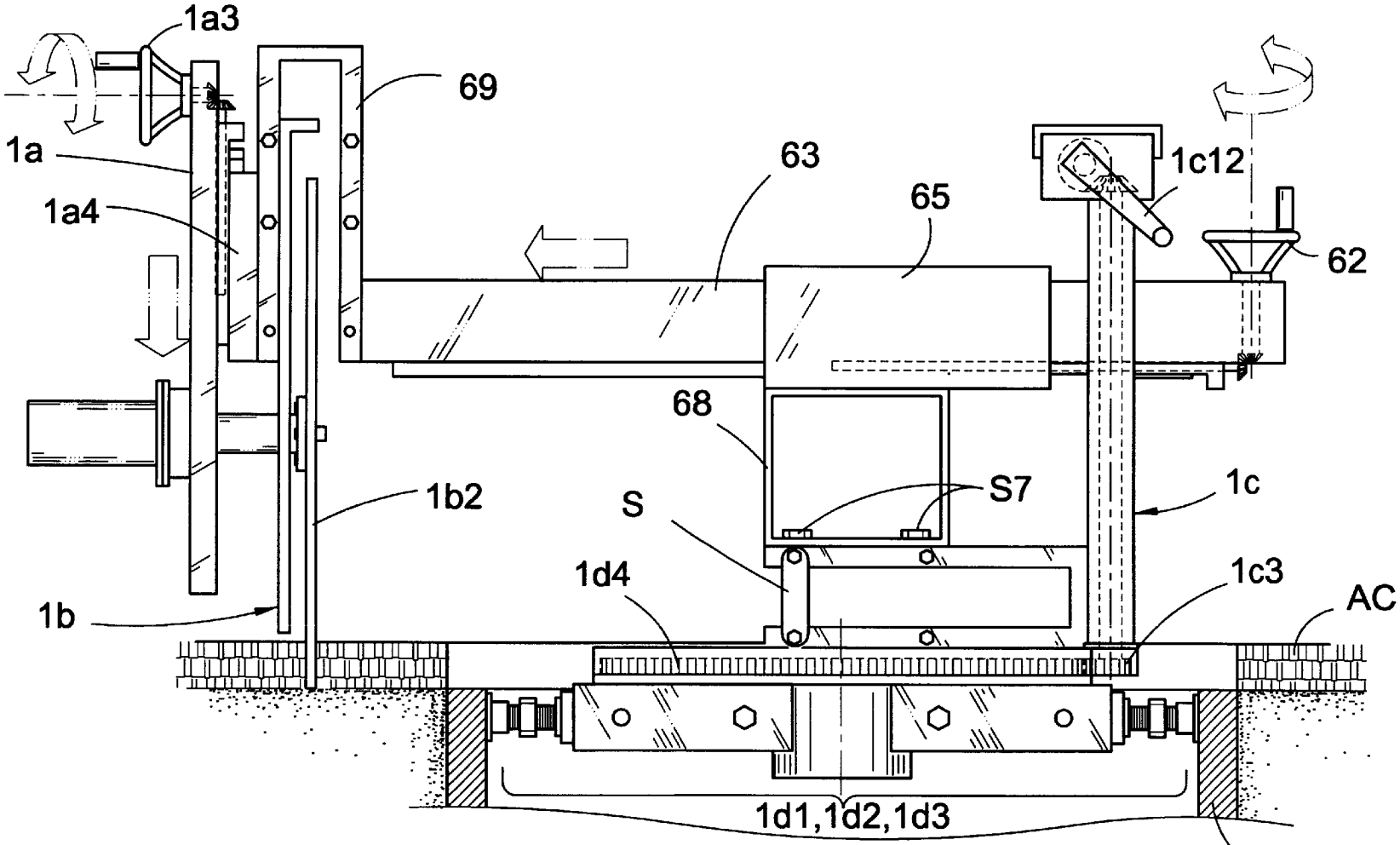
FIG. 4(B) is an elevation view of the cutting unit of the present invention cutting the surface of an asphalt road.

As shown in FIG. 4(A), when the cutting unit 1 of the present invention is placed into a culvert H1, the internal sleeve 1*d*14 and the external sleeve 1*d*15 of the extending arms 1*d*1, 1*d*2 and 1*d*3 are fastened by the screw S5 after being adjusted to the proper position (the adjusting motion of the structure of 1*d*2 and 1*d*3 are the same as that of 1*d*1). Then, the fastening nut 1*d*12 on the screw bolt 1*d*13 is turned to make the fastening set 1*d*11 on the screw bolt 1*d*13 hold against the inner wall of the culvert H1. At this time, the turning wheel 1*a*3 of the radial feeding mechanism 1*a* can be turned to rotate the bevel gear 1*a*31, and the gear 1*a*54 is driven to drive the screw 1*a*53. Then, the housing 1*a*2 of the radial feeding mechanism 1*a* shifts due to rotation of the screw 1*a*53. The pneumatic motor 1*a*1 on the housing 1*a*2 is driven simultaneously, and the circular blade 1*b*2 is driven because the lock plate 1*b*3 is fixed to the shaft 1*a*11 at the bottom of the pneumatic motor 1*a*1. After the circular blade 1*b*2 starts to contact the inner wall of the culvert H1, due to turning the turning wheel 1*a*3 of the radial feeding mechanism 1*a*, the user can go on turning the turning wheel 1*a*3 to decide cutting depth, and the shelter 1*b*1 of the cutting unit 1*b* prevents splashing cut pieces. When the circular blade 1*b*2 reaches the cutting depth, the user can turn the turning grip 1*c*12 of the steering gear mechanism 1*c*1 to drive the bevel gear pair 1*c*11 such that the shaft 1*c*2 of the chassis 1*d* is driven to drive the planet gear 1*c*3 and thereby drive the fixed gear 1*d*41. The cutting plate 1*b* of the radial feeding device 1*a* is thus driven to have circular motion due to rotation of the fixed gear 1*d*41. The velocity of circular motion of the cutting plate 1*b* is the cutting speed of the cutting unit cutting the culvert H1. The manhole/handhole set H2 can be taken out after the cutting task is finished.

With reference to FIG. 4(B), an extended screw feeding mechanism 6 can also be added to the cutting unit to work in coordination with the cutting task before the present invention is used to cut the culvert H1. First, the extending arms 1*d*1, 1*d*2, and 1*d*3 are used to hold the base 1*d* in the manhole/handhole H2. Then, the radial feeding mechanism and the cutting plate 1*b* described above are positioned for use, and the guide block 1*a*4 of the radial feeding mechanism 1*a* is fastened on the fastening holder 69 of the extended feeding mechanism 6. The fastening prop 68 is fixed on the fixing holder 1*c*4 of the chassis 1*c* via screws S7. For increasing the stability of the present invention, after the extended screw feeding mechanism is added, a link S can be added on the fixing holder 1*c*4 of the chassis 1*c*. When the user operates the turning wheel 62, the sliding block 63 is driven in the guide block 65, and the movement of the sliding block 63 drives the radial feeding mechanism 1*a* to move in a direction parallel to the surface of an asphalt road AC (the amount of the displacement would determine the area of the asphalt road to be cut). After determining the amount of the displacement of the radial feeding mechanism 1*a*, the user can operate the turning wheel 1*a*3 to adjust the amount of vertical displacement of circular blade 1*b*2 (i.e. the depth of the asphalt road to be cut). Then, the user operates the turning grip 1*c*12 to drive the planet gear 1*c*3. Meanwhile, the planet gear 1*c*3 drives the fixed gear 1*d*4 (which is the cut speed of cutting the surface of the asphalt road). In this way, cutting unit 1 can carry out the task of cutting a circular path according to the amount of displacement of the radial feeding device, the feeding amount of the cutting plate, and the cutting speed of the fixed gear 1*d*4.

Figure 5:
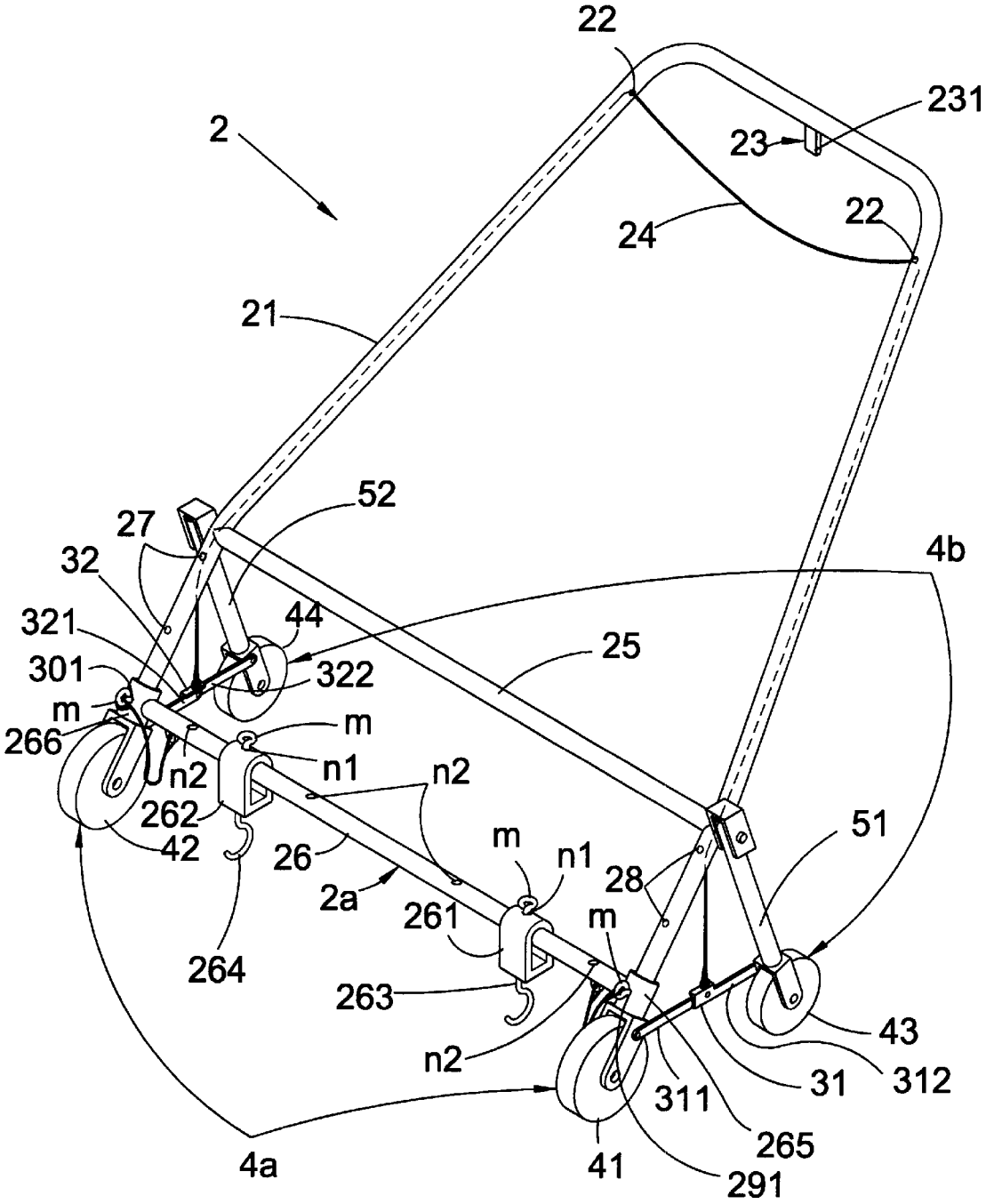
FIG. 5 is a perspective view of the lifter of the present invention.

As shown in FIG. 5, the lifter 2 is composed of a frame 21, a pair of fastened wheels 4*a*, a pair of mobile wheels 4*b*, a hook module 2*a*, several positioning pins m, a pair of folding units 31 and 32, a string 24, and a stopping unit 23. Several symmetrical position holes 27 and 28 are disposed at proper positions in the frame 21. The pair of fastened wheels 4*a* include a wheel 41 and a wheel 42, and are respectively located on both sides of one end of the frame 21. The pair of mobile wheels 4*b*, include the wheels 43 and 44, respectively mounted on the mobile links 51 and 52 joined at two sides of the frame 21. The hook module 2*a* is mainly composed of a stick 26, and a pair of mobile sleeves 261, 262 are set on the stick 26. Hooks 263, 264 are respectively located at the bottom of the mobile sleeves 261, 262, and several positioning holes n1 are formed at the top of the mobile sleeves 261, 262. Several positioning holes n2 are formed in the stick 26. A pair of sleeves 265, 266 are located at both ends of the stick 26. The sleeves 265, 266 can slide on the frame 21, and the position holes 291, 301 are respectively formed in the sleeves 265, 266. The positioning pins m are used to fix the hook module 2*a*.

The folding units 31 and 32 respectively contain a pair of foldable links 311, 312 and 321, 322. The stopping unit 23 contains a stopping plate 231, which is fixed at a proper position on the frame 21, to prevent the frame 21 from contacting the ground when the frame 21 is placed down horizontally. The wheel 41 and the wheel 42 of the pair of fastened wheels 4*a* are respectively located at both sides of one end of the frame 21, and the pair of mobile wheels are located at the outside of the pair of fastened wheels 4*a* and corresponds to the pair of fastened wheels. A pair of folding units 31, 32 are used to link fastened wheels 4*a* and mobile wheels 4*b*. The pair of folding units 31, 32 are connected by a string 24 passing through the frame 21. Whereby, when the string is pulled, the pair of fastened wheels 4*a* and the pair of mobile wheels 4*b* are pulled by the pair of folding units 31, 32, such that the foldable links between the pair of fastened wheels 4*a* and the pair of mobile wheels 4*b* are folded. The positioning pins m simultaneously pass through the positioning holes n1 of the mobile sleeves of the hook module 2*a*, the positioning holes n2 of the stick 26, the position holes 291, 301 of the sleeves 265, 266, and the positioning holes 27, 28 on the frame 21, such that the position of the mobile hooks 263, 264 of the hook module 2*a* can be set.

Figure 6A:
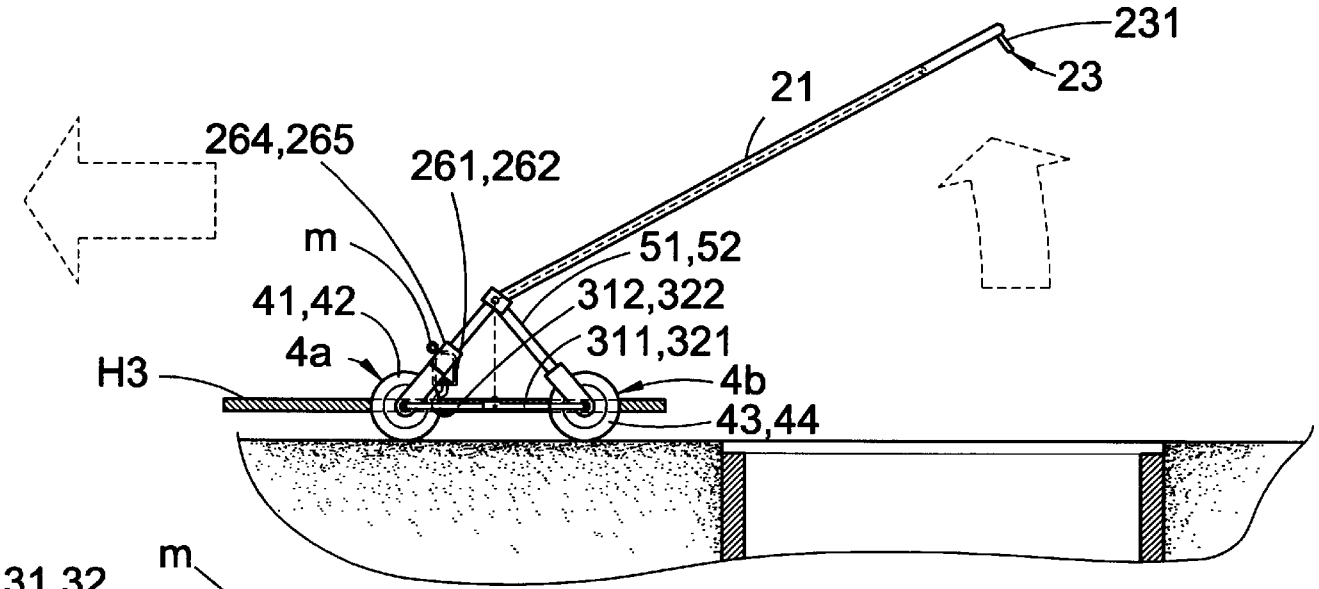
FIG. 6(A) is an elevation view of the lifter of the present invention hanging a manhole/handhole cover.
Figure 6B:
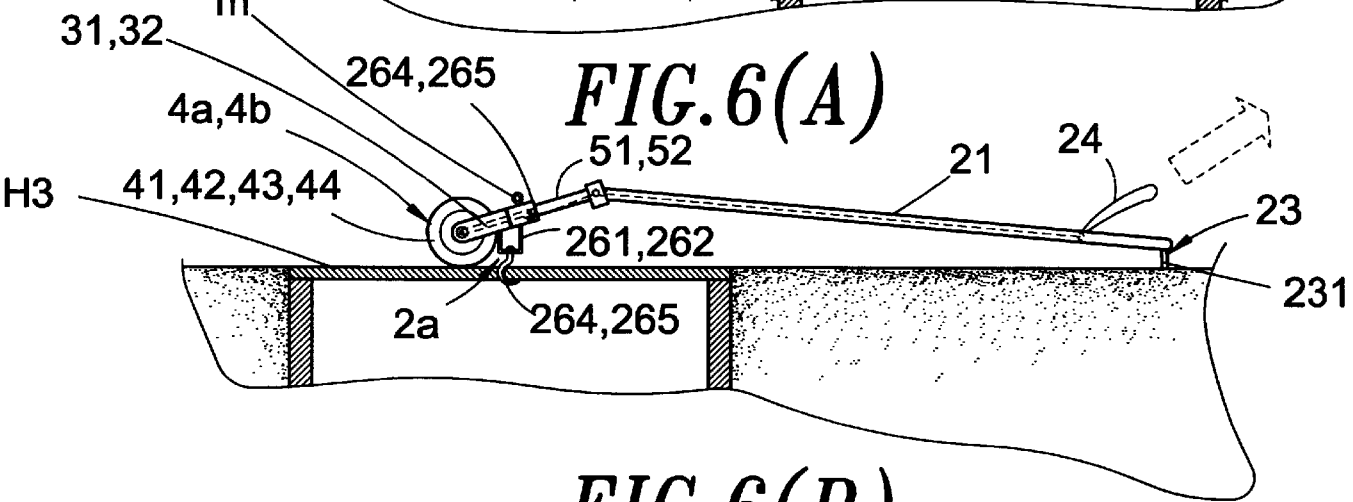
FIG. 6(B) is an elevation view of the lifter of the present invention moving a manhole/handhole cover.

Referring to FIGS. 6(A) and 6(B), when lifting the manhole/handhole cover H3, the user first pulls the string 24, and both ends of the string 24 pull the folding unit 31, 32 such that the foldable link 311, 312 and 321, 322 are folded. When the folding units 31, 32 are folded, the foldable links 312, 322 respectively pull the mobile links 51, 52. After the folding units 31, 32 are folded, the mobile links 51 and 52 pull the pair of mobile wheels 4*b* to the outside of the pair of the fastened wheels 4*a*. At this time, the user places the frame 21 downward. The hands of the user are protected from being pinched by the stopping plate 231 of the stopping unit 23. The mobile sleeves 261, 262, and the sleeves 264, 265 are adjusted, and at the same time, the positioning pins m are used to pass through the position holes n1, position holes 291 and 301, then hooks 264, and 265 are used to hand the manhole/handhole cover, and the manhole/handhole cover H3 can be lifted easily because of the leverage provided by the frame (i.e. the point contacting ground of the pair of fastened wheels 4*a* are supports, and the hanging positions of the hook module 2*a* are anti-force points, and the other end opposite to the pair of fastened wheels are force-applying points). After the manhole/handhole cover H3 is lifted, the string 24 is loosened and then, the pair of the mobile wheels 4*b* pull the folding units 31 and 32 to a horizontal state, due to the momentum of the wheel 43 and the wheel 44, and the manhole/handhole cover H3 can then be lifted. In this way, the user can easily move a manhole/handhole cover H3 by the mobility of the pair of fastened wheels 4*a* and mobile wheels 4*b*.

Figure 7:
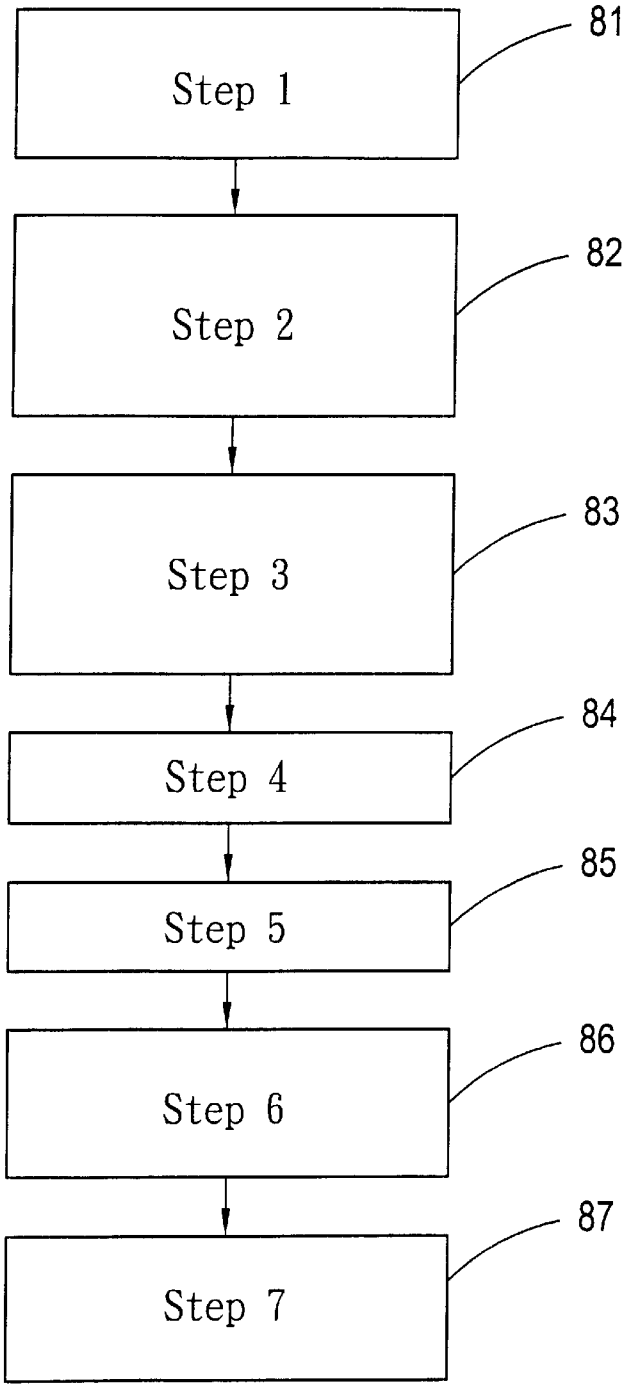
FIG. 7 is a flowchart of construction steps of the present invention.

As shown in FIG. 7, the construction method can be divided into steps as follows:

Step 1 81, Using a lifter to lift and move a manhole/handhole cover;

Step 2 82, Placing and positioning the cutting unit into the manhole/handhole, and using the cutting unit to cut the surface of the asphalt road around the manhole/handhole;

Step 3 83, Placing and positioning the cutting unit into the culvert, and using the cutting unit to cut the culvert connected to the bottom of the manhole/handhole;

Step 4 84, Hoisting out the manhole/handhole;

Step 5 85, Placing a new manhole/handhole;

Step 6 86, Using the lifter to move the manhole/handhole cover and cover the new manhole/handhole; and Step 7 87, Laying an asphalt road surface around the manhole/handhole.

Applying the devices, mechanisms and operation method described above smoothly carry out the construction method of the present invention.

Figure 8:
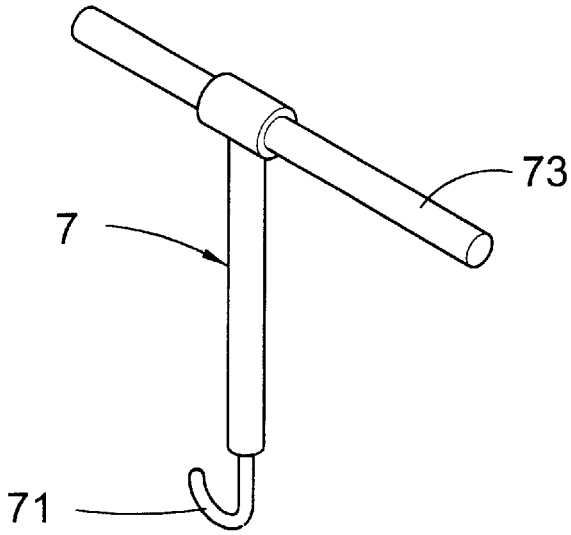
FIG. 8(A) is a perspective view of a fastening position hook of the present invention.
FIG. 8(B) is a perspective view of a mobile position hook of the present invention; and, FIG. 8(C) is a perspective view showing the application of the position hooks of the present invention.
Figure 8:
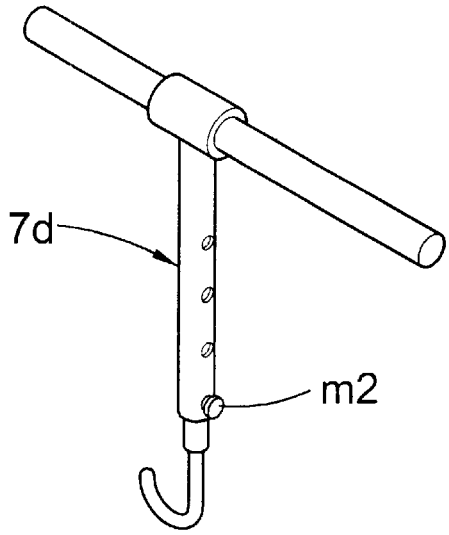
Figure 8:
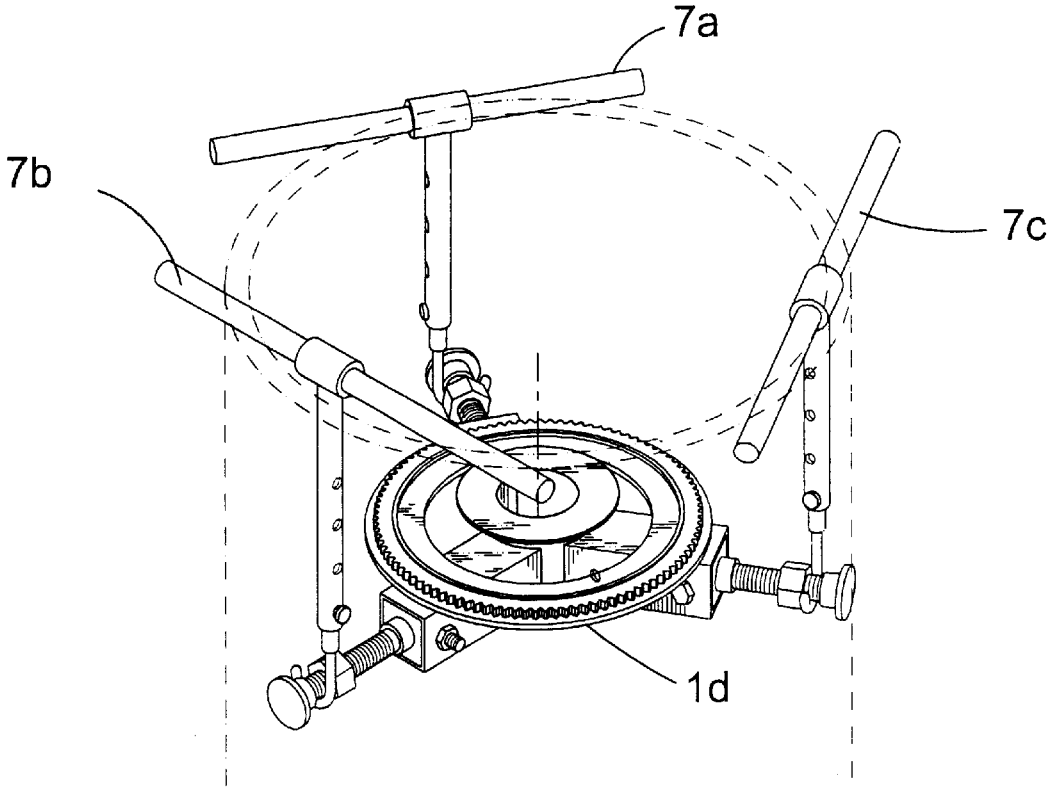

With respect to FIGS. 8(*a*), 8(B) and 8(C), when the cutting unit 1 is placed into the culvert H1 or manhole/handhole H2, the position hooks 7 having the same size can be taken together to fasten, via grappling, the extending arms 1*d*1, 1*d*2, 1*d*3 of the base 1*d* by the hook 71. When an insetting motion is carried out, the stick 73 of the position hook 7 can be lodged at the outer periphery of the culvert H1 and manhole/handhole H2 (as the position hooks 7*a*, 7*b*, and 7*c* shown in FIG. 8(C)) to provide quick positioning. Besides, the length of the position hook 7*d* can also be adjusted by the method of using positioning pins m2.

When comparing to the noted prior art or other conventionally used technologies, the quick manhole/handhole method and related devices of the present invention have advantages as follows:

(1) Power needed to drive the blade is little, so less energy is consumed.

(2) The task of replacement of the manhole/handhole can be carried out quickly and efficiently.

(3) Because the components of the present invention are simple, the cost is low, the operation is easy, and less operating staff is needed.

(4) The cutting task using the present invention makes the cut surface neat and does not have the bursting condition that traditionally results from the hammering method, which method has a greater maintenance.

(5) The present invention uses a pneumatic motor or a hydraulic motor to serve as the driving force for driving the cutting blade, and, therefore, the worry that flammable gas, such as marsh gas, will be ignited is avoided.

(6) The lifter of the present invention uses the principle of a lever to achieve an effort-saving purpose, and move the manhole/handhole cover easily and quickly. Besides, the structure is simple, and operation is easy.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A quick manhole/handhole construction method, comprising the steps of:

a. providing a cutting unit, said cutting unit including:

a radial feeding device composed of a pneumatic motor and a screw feeding mechanism;

a circular blade unit covered by a shelter having a placing prop fastened at a predetermined position on an exterior of said shelter;

a chassis with a fixing holder mounted thereon and a column casing mounted at a predetermined peripheral position of said chassis, said chassis including a steering gear mechanism mounted on a top of said column casing, said steering gear mechanism including a shaft extending downwardly therefrom and a planet gear fastened on said shaft;

a base having a fixed gear fastened on an upper surface of said base and at least three adjustably extending arms equidistantly spaced on a bottom face with equal parts;

a vessel which is connected with a duct being mounted on said placing prop on said shelter;

said shelter and said radial feeding device being fastened to said fixing holder of said chassis, and said circular blade unit being fastened to said pneumatic motor of said radial feeding device, said chassis being mounted on a top of said base, and said planet gear being engaged with said fixed gear set on said base;

b. placing and positioning said cutting unit into a manhole/handhole;

c. using said cutting unit to cut a surface of an asphalt road above said manhole/handhole;

d. placing and positioning said cutting unit into a culvert;

e. using said cutting unit to cut said culvert connected to a bottom of said manhole/handhole; and, f. replacing said manhole/handhole.

2. The method as recited in claim 1, wherein the step of placing said positioning said cutting unit is preceded by the step of providing a lifter, said lifter including:

a frame having a plurality of symmetrical position holes located at predetermined positions;

a pair of fastened wheels respectively set at both sides of one end of said frame;

a pair of mobile wheels respectively coupled to a mobile link, which is joined at two sides of said frame;

a hook module, wherein a main part thereof is a stick with a pair of sleeves respectively set at two ends thereof to be slidable on said frame, said pair of sleeves having a pair of positioning holes respectively formed therein, said hook module including a pair of mobile sleeves disposed on said stick, each of said mobile sleeves having a hook at a bottom thereof and a poisoning hole at a top of said mobile sleeve;

a plurality of the positioning pins for fastening said hook module to said frame;

a pair of folding units respectively coupled between said pair of fastened wheels and said pair of mobile wheels, each of said folding units including a pair of foldable links and a string passing through said frame such that when said string is pulled, said pair of fastened wheels and said pair of mobile wheels can be pulled by said pair of folding units to be folded; and, a stopping unit including at least a stopping plate fixed at a predetermined position on said frame for preventing said frame from contacting a ground surface when said frame is horizontally disposed.

3. The method as recited in claim 2, wherein the step of providing a lifter includes the step of using said lifter to lift and move a manhole/handhole cover; and wherein the step of replacing said manhole/handhole includes the steps of lifting out and moving away said manhole/handhole, placing a new manhole/handhole in position, using said lifter to move a cover for said new manhole/handhole, and repairing said surface of said asphalt road above said manhole/handhole.

4. The method as recited in claim 1, wherein the step of providing a cutting unit includes the steps of connecting an extended screw feeding mechanism to said screw feeding mechanism and said fixing holder of said chassis, and connecting a fastening holder normal to said fixing holder at one end of said extended screw feeding mechanism, and said radial feeding device can be fastened to said fastening holder.

5. The method as recited in claim 1, wherein the step of placing and positioning said cutting unit into a manhole/handhole includes the steps of providing a plurality of position hooks and fastening said plurality of position hooks between said extending arms of said base and an upper edge of said manhole/handhole.

6. The method as recited in claim 1, wherein the step of placing and positioning said cutting unit into a culvert includes the steps of providing a plurality of position hooks, fastening said plurality of position hooks between said extending arms of said base and an upper edge of said manhole/handhole, and adjusting a length of each said hook with a position pin.

7. A quick manhole/handhole construction method, comprising the steps of:

a. providing a cutting unit, said cutting unit including:

a radial feeding device composed of a hydraulic motor and a screw feeding mechanism;

a circular blade unit covered by a shelter having a placing prop fastened at a predetermined position on an exterior of said shelter;

a chassis with a fixing holder mounted thereon and a column casing mounted at a predetermined peripheral position of said chassis, said chassis including a steering gear mechanism mounted on a top of said column casing, said steering gear mechanism including a shaft extending downwardly therefrom and a planet gear fastened on said shaft;

a base having a fixed gear fastened on an upper surface of said base and at least three adjustably extending arms equidistantly spaced on a bottom face with equal parts;

a vessel which is connected with a duct being mounted on said placing prop on said shelter;

said shelter and said radial feeding device being fastened to said fixing holder of said chassis, and said circular blade unit being fastened to said hydraulic motor of said radial feeding device, said chassis being mounted on a top of said base, and said planet gear being engaged with said fixed gear set on said base;

b. placing and positioning said cutting unit into a manhole/handhole;

c. using said cutting unit to cut a surface of an asphalt road above said manhole/handhole;

d. placing and positioning said cutting unit into a culvert;

e. using said cutting unit to cut said culvert connected to a bottom of said manhole/handhole; and, f. replacing said manhole/handhole.

* * * * *